US007146666B2

(12) United States Patent
Christofferson et al.

(10) Patent No.: US 7,146,666 B2
(45) Date of Patent: Dec. 12, 2006

(54) SEAT CUSHION AND METHOD FOR CARRYING PRESSURE-DISTRIBUTING MEDIUM IN A SEAT CUSHION

(75) Inventors: James L. Christofferson, Longment, CO (US); Thomas J. Whelan, Longmont, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 10/675,089

(22) Filed: Sep. 30, 2003

(65) Prior Publication Data

US 2005/0066445 A1 Mar. 31, 2005

(51) Int. Cl.
*A47C 27/18* (2006.01)

(52) U.S. Cl. ..... 5/654; 5/653; 5/922

(58) Field of Classification Search ..... 5/653–654, 5/630, 639, 922

See application file for complete search history.

(56) References Cited

U.S. PATENT DOCUMENTS 5,168,590 A * 12/1992 O'Sullivan ..... 5/490
5,395,162 A * 3/1995 Jay et al. ..... 297/452.25
5,592,707 A * 1/1997 Dinsmoor et al. ..... 5/654
6,151,733 A * 11/2000 Takashima ..... 5/636
6,901,617 B1 * 6/2005 Sprouse et al. ..... 5/654
2003/0205920 A1 11/2003 Sprouse, II et al.

* cited by examiner

*Primary Examiner*—Suzanne Dino Barrett
*Assistant Examiner*—Fredrick Conley
(74) *Attorney, Agent, or Firm*—MacMillan, Sobanski & Todd, LLC

(57) ABSTRACT

A seat cushion includes a cushion base, a pressure-distributing medium, and a cover. The base supports the pressure-distributing medium. The cover has a pocket for receiving the pressure-distributing medium and covers the base and the pressure-distributing medium therein. A method for carrying the pressure-distributing medium in a personal mobility vehicle cushion comprises the steps of providing a cushion cover having a pocket, inserting a pressure-distributing medium in the pocket, and inserting a base in the cover so that the pressure-distributing medium is positioned above the base.

11 Claims, 4 Drawing Sheets

SEAT CUSHION AND METHOD FOR CARRYING PRESSURE-DISTRIBUTING MEDIUM IN A SEAT CUSHION

BACKGROUND OF INVENTION

This invention relates to an apparatus and method for alleviating or preventing excessive pressure, and therefore pressure sores, from developing on a contacted area of a person's body. More particularly, the invention relates to a seat cushion for a personal mobility vehicle, wherein the cushion has a pressure-distributing medium for alleviating or preventing excessive pressure from developing on a contacted area of the user's body.

A pressure sore is any lesion caused by excessive, unrelieved pressure on an area of a person's body. When pressures above normal homeostatic pressure are applied to a region of the person's body and its associated blood vessels, the blood vessels can partially or fully collapse, thereby disrupting normal circulation. As a result, the affected area becomes devoid of blood supply, which prohibits oxygen and nutrients from being delivered to the surrounding tissue. Pressure sores often occur over bony prominences of the person and can range in severity from partial thickness skin loss to full thickness skin loss with tissue necrosis and damage to underlying muscle and bone.

Pressure sores are a common and costly problem in wheelchair occupants. Various areas of the occupant's body may be permanently or almost permanently in contact with the support surface of the wheelchair, resulting in excessive pressure, lack of air circulation, and often increased shear between the contacted area of the occupant's body and the support surface.

Various systems have been proposed to reduce or prevent pressure sores. Among the most common prevention systems are cushions or pads that include some type of raised surface that is designed to lower the pressure between the bony prominences and the support surface and equalize the pressure over the entire surface in contact with the occupant's body. In order to be effective in this capacity, the raised surface is designed to keep the bony prominences away from the support surface. However, upon the application of pressure by contact with the occupant's body, the raised surface tends to compress so that the bony prominences rest against the support surface anyway. This action negates any lowering of pressure of the affected area, while also decreasing aeration and increasing the potential for shear between the occupant's body and the cushion.

More sophisticated support surfaces employ a pressure-distributing medium in combination with a cushion base. The most common medium is a fluid pad that is positioned on top of the base. The fluid pad moves with the occupant's body to continually maintain an even distribution of the occupant's weight across the surface of the cushion base.

Conventional fluid pads are held in a fixed relation to the cushion base by enclosing the pad in an envelope and attaching the envelope to the base with hook-and-loop fasteners or by providing an inner cover for covering the base and attaching the pad to the cover with hook-and-loop fasteners.

What is needed is a support surface that eliminates the need for an envelope or an inner cover and thus requires fewer production materials and reduces production costs.

SUMMARY OF INVENTION

The present invention is directed toward an apparatus that meets the foregoing needs. The apparatus may be in the form of a cover for a seat cushion for a personal mobility vehicle, wherein the cover has a pocket therein for receiving a pressure-distributing medium.

The present invention is directed toward a method for a carrying pressure-distributing medium in a wheelchair cushion cover, wherein the method comprises the step of providing a wheelchair cushion cover having a pocket therein for receiving a pressure-distributing medium.

Various objects and advantages of this invention will become apparent to those skilled in the art from the following detailed description of the preferred embodiment, when read in light of the accompanying drawings.

DETAILED DESCRIPTION

Figure 1:
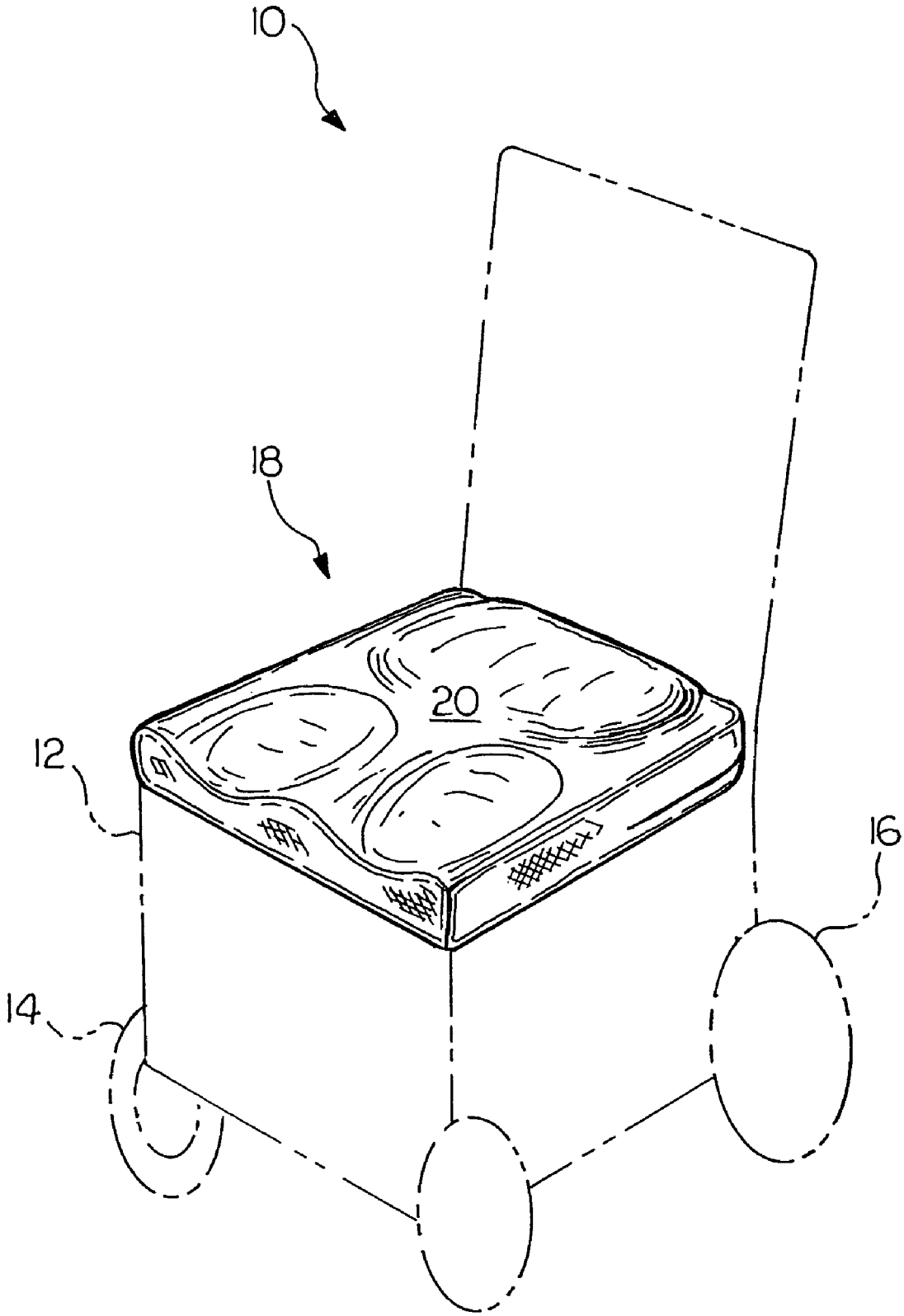
FIG. 1 is a front perspective view of a personal mobility vehicle having a seat cushion according to a preferred embodiment of the invention.

Now, with reference to the drawings, there is illustrated in FIG. 1 a personal mobility vehicle 10, which may be in the form of a wheelchair, a scooter, or the like. The vehicle 10 comprises a frame 12, having a plurality of wheels 14, 16 supported relative thereto for supporting and propelling the frame relative to a supporting surface. The frame 12 supports a supporting surface 18 in the form of a seat that is adapted to support an occupant (not shown).

Figure 2:
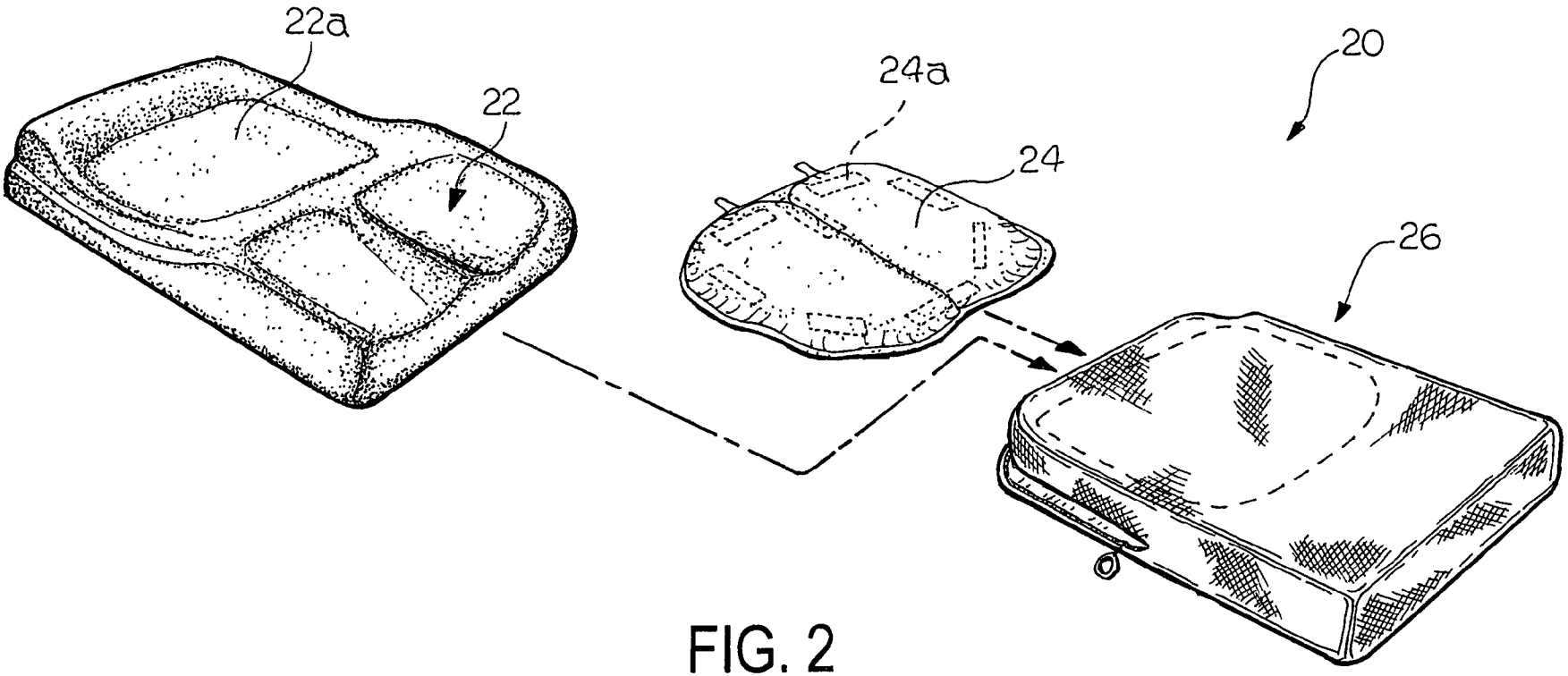
FIG. 2 is an exploded front perspective view of the seat cushion shown in FIG. 1.

In accordance with the present invention, a seat cushion 20 is provided for use with the supporting surface 18. As shown in FIG. 2, the seat cushion 20 comprises a base 22, a pressure-distributing medium 24, and a cover 26. The base 22 supports the pressure-distributing medium 24. The cover 26 covers the base 22 and the pressure-distributing medium 24 supported thereby.

The base 22 may be formed from any suitable material, including but not limited to foam materials, such as polyurethane foam materials. The base 22 should be a sufficient width for the wheelchair occupant and may include one or more layers, such as a dense stable inner layer and a soft outer contoured layer. The inner layer may provide a stable foundation for postural support and the outer layer may be contoured to provide increased surface contact for improved pressure distribution to increase sitting tolerance and reduce the risk of skin breakdown. A layer of slow-memory, visco-elastic foam may be provided for further enhancing stability and positioning and reducing sliding and shear. The base 22 may further include a posterior seat well, as indicated at 22*a*, for receiving the bony prominences of the wheelchair occupant.

The pressure-distributing medium 24 may take on any suitable form, including but not limited to a fluid pad. Such a pad may include a urethane membrane having a fluid therein. The membrane may be oversized to provide maximum reduction in shear forces and protect against moisture. The fluid may be any suitable gas or liquid, having high-viscosity and non-compressible properties. The fluid may include a fixotropic fluid, such as the fluid disclosed in U.S. Pat. No. 6,455,623, to David L. Howard, which is incorporated herein by reference.

The pressure-distributing medium 24 may cover the entire base 22 or just a portion thereof. For example, the pressure-distributing medium 24 may be contained in the seat well 22*a* for controlling fluid mitigation to the rear of the seat well 22*a*. The pressure-distributing medium 24 may conform to the bony prominences of the wheelchair occupant to permit immersion of the ischials and coccyx without resistance and provide maximum pressure distribution, and pressure and shear reduction.

Although not shown, a variety of secondary supports can be provided, for example, to position and maintain optimal pelvic and lower extremity support. These supports include but are not limited to adductor wedges, abductor wedges, pelvic obliquity buildup, hip guides, and base wedges, to name a few.

The cover 26 is preferably structured to encapsulate or completely cover the base 22 and the pressure-distributing medium 24 supported thereby. The cover 26 may be formed from any suitable material and preferably includes a fluid or moisture resistant material, preferably nylon, for incontinence.

Figure 3:
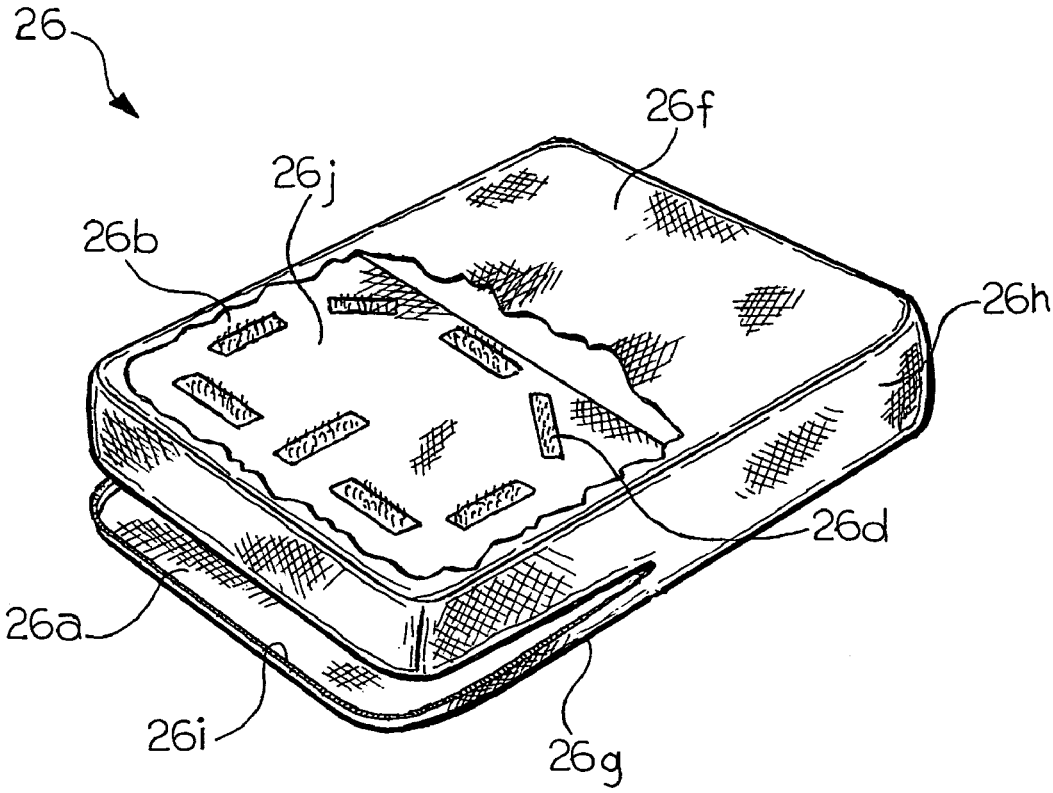
FIG. 3 is a partially cutaway, rear perspective view of a seat cushion cover according to a preferred embodiment of the invention.

The cover 26 has a top, a bottom, and peripheral sides. An opening 26*a*, as shown in FIG. 3, is provided at the rear thereof for receiving the base 22. An interior pocket 26*b* is provided within the cover 26. The pocket 26*b* may extend that entire area of the top of the cover 26. However, in the illustrated embodiment, the pocket 26*b* is provided at the rear of the cover 26, near the opening 26*a*. The illustrated pocket 26*b* is closed along the rear and lateral sides of the cover 26. An opening 26*c* along the front of the pocket 26*b* is provided for the insertion of the pressure-distributing medium 24. Fasteners are preferably located inside the pocket 26*b* for securing the pressure-distributing medium 24 in the pocket 26*b*. In a preferred embodiment of the invention, fastening elements 26*d*, such as hook portions of hook-and-loop type fasteners are provided in the pocket 26*b*. The fastening elements 26*d* cooperate or mate with fastening elements 24*a* (shown in FIG. 2), such as loop portions of hook-and-loop type fasteners, on the pressure-distributing medium 24 to secure the pressure-distributing medium 24 in the pocket 26*b*.

It should be appreciated that the cover 26 may include top and bottom fabric panels 26*f*, 26*g* joined together by one or more side fabric pieces, indicated generally at 26*h*. The opening 26*a* can be provided between the top and bottom fabric panels 26*f*, 26*g* and may be opened or closed via one or more fasteners, including but not limited to the slideable fastener or zipper 26*i* shown. The pocket 26*b* can be formed from a single piece of fabric 26*j* stitched or otherwise secured to the an underside of a top panel 26*f* of the cover 26*b* so that the opening 26*c* is presented in the front of the pocket 26*b*. In the preferred embodiment, the fastening elements 26*d* are affixed to the top of the single piece of fabric 26*j*. The mating fastening elements 24*a* are affixed to a bottom of the pressure-distributing medium 24. The pressure-distributing medium 24 is adapted to be inserted in the pocket 26*b* so that the fastening elements 24*a*, 26*d* are secured together to hold the pressure-distributing medium 24 firmly in the pocket. In this way, the fastening elements 24*a*, 26*d* are positioned beneath the pressure-distributing medium 24 when the cushion 26 is supporting the wheelchair occupant.

It should be understood that the cover 26 is not intended to be limited to that shown and described. For example, the side panels may be integral with the top and bottom panels. The opening 26*a* may be elsewhere other than the back of the cushion 26. The fastener 26*i* for closing the cover opening 26*a* is not intended to be limited to a zipper, as shown. The pocket opening 26*c* can be provided elsewhere, such as along the rear or sides, or in the piece of fabric 26*j* (e.g., a slit) forming the pocket 26*a*.

Figure 4:
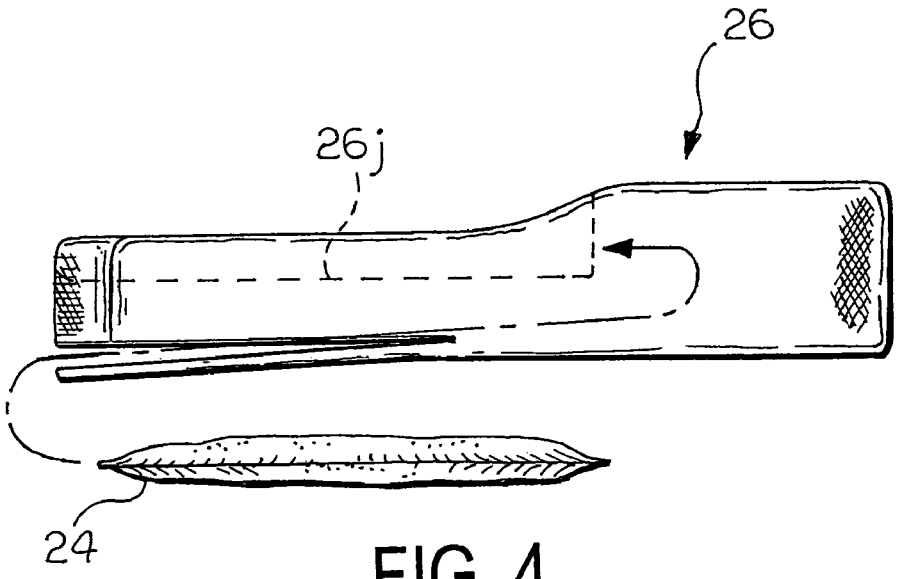
FIG. 4 is an exploded side elevational view of the cover and a pressure-distributing medium according to a preferred embodiment of the invention.
Figure 5:
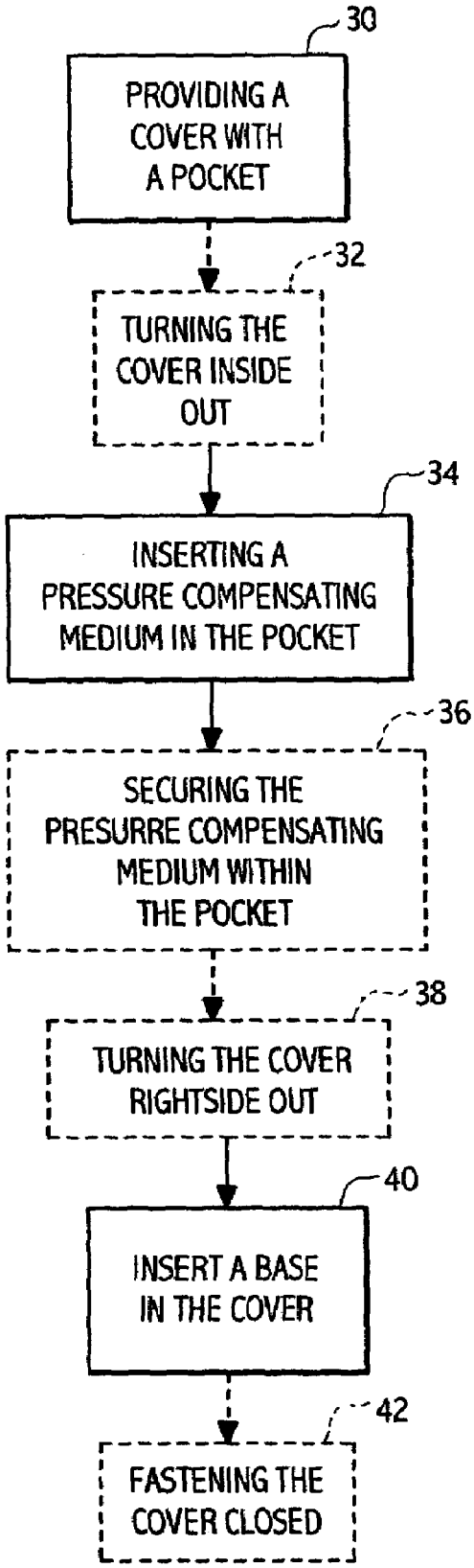
FIG. 5 is a flow chart depicting a method for carrying a pressure-distributing medium according to a preferred embodiment of the invention.

In accordance with the present invention, a method for carrying the pressure-distributing medium 24 in personal mobility vehicle cushion 20 is provided. As shown in FIG. 4, the method comprises the initial step of providing a cushion cover having a pocket, as shown in function step 30. In a subsequent step, function step 34, a pressure-distributing medium is inserted in the pocket. A base is then inserted in the cover so that the pressure-distributing medium is positioned above the base, as shown in function step 40. In an optional step, function step 42, the cover is fastened closed.

In the initial step, function step 30, the pocket could be provided within the cover with an opening facing interiorly and preferably forward of the cover. In an optional step, function step 32, the cover can be turned inside out prior to inserting the pressure-distributing medium in the pocket. After the pressure-distributing medium is inserted in the pocket, the cover can be turned right side, as shown in function step 38, prior to inserting the base in the cover.

In yet another optional step, function step 36, immediately following function step 34, the pressure-distributing medium is secured to the inside of the pocket. This is preferably accomplished using hook-and-loop type fasteners.

The cushion 10 set forth above is preferably a lightweight, comfortable, and low-maintenance cushion that does not restrict movement, allowing the wheelchair occupant to change positions on the cushion 10.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A seat cushion for a personal mobility vehicle, the seat cushion comprising:

a base;

a pressure-distributing medium supported by the base; and a cover covering the base and the pressure-distributing medium, wherein the cover comprises:

a pocket for receiving the pressure-distributing medium; and top and bottom fabric panels joined together with an opening provided therebetween that is selectively opened and closed via one or more fasteners, wherein a first fastening element is affixed to a top surface of a piece of fabric and a second fastening element is affixed to a bottom of the pressure-distributing medium, the first and second fastening element being adapted to be secured together to hold the pressure-distributing medium firmly in the pocket.

2. The seat cushion of claim 1, wherein the pressure-distributing medium is a fluid pad.

3. The seat cushion of claim 1, wherein the base includes a posterior seat well for receiving bony prominences of a wheelchair occupant.

4. The seat cushion of claim 3, wherein the pocket is positioned at a rear of the cover substantially over the seat well.

5. The seat cushion of claim 1, wherein the pocket is provided within the cover.

6. The seat cushion of claim 1, further including at least one fastener along the pocket for securing the pressure-distributing medium therein.

7. The seat cushion of claim 6, wherein the at least one fastener is in the form of a hook-and-loop type fastener.

8. The seat cushion of claim 1, wherein the one or more fasteners is a slideable fastener.

9. A method for carrying a pressure-distributing medium in a personal mobility vehicle cushion, the method comprising the steps of:

a) providing a cushion cover having a pocket with a first portion of a hook-and-loop type fastener in the pocket;

b) providing a pressure-distributing medium with a second portion of a hook-and-loop type fastener;

c) inserting a pressure-distributing medium in the pocket;

c) securing the pressure-distributing medium to the inside of the pocket by mating the first and second portions; and d) inserting a base in the cover so that the pressure-distributing medium is positioned above the base.

10. The A seat cushion for a personal mobility vehicle, the seat cushion comprising:

a base; a pressure distributing medium with a first fastening element supported by the base, the pressure-distributing medium having a first fastening element; and a cover covering the base and the pressure-distributing medium, wherein the cover comprises:

a pocket for receiving the pressure-distributing medium having a second fastening element within the pocket; securing the pressure-distributing medium to the inside of the pocket by mating the first and second fastening elements; and top and bottom fabric panels joined together with an opening provided therebetween that is selectively opened and closed via one or more fasteners, wherein the pocket is formed from a piece of fabric secured adjacent an underside of the top fabric panel so that an opening is presented along one side of the pocket, and wherein the pocket opening is at a front end thereof.

11. A seat cushion for a personal mobility vehicle, the seat cushion comprising:

a base; a pressure distributing medium with a first fastening element supported by the base, the pressure-distributing medium having a first fastening element; and a cover covering the base and the pressure-distributing medium, wherein the cover comprises:

a pocket for receiving the pressure-distributing medium having a second fastening element within the pocket; securing the pressure-distributing medium to the inside of the pocket by mating the first and second fastening elements; and top and bottom fabric panels joined together with an opening provided therebetween that is selectively opened and closed via one or more fasteners, wherein the pocket is formed from a piece of fabric secured adjacent an underside of the top fabric panel so that an opening is presented along one side of the pocket, and wherein the pocket is closed along rear and lateral sides of the cover.

* * * * *

UNITED STATES PATENT AND TRADEMARK OFFICE

CERTIFICATE OF CORRECTION

PATENT NO. : 7,146,666 B2
APPLICATION NO. : 10/675089
DATED : December 12, 2006
INVENTOR(S) : James L. Christofferson et al.

It is certified that error appears in the above-identified patent and that said Letters Patent is hereby corrected as shown below:

Column 5, Claim 10, Line 34, after "base" delete ", the pressure-distributing medium having a first fastening element";

Column 6, Claim 11, Line 18, after "base" delete ", the pressure-distributing medium having a first fastening element".

Signed and Sealed this

Twelfth Day of February, 2008

JON W. DUDAS
*Director of the United States Patent and Trademark Office*